US006401247B1

(12) United States Patent
Williams, IV

(10) Patent No.: US 6,401,247 B1
(45) Date of Patent: Jun. 11, 2002

(54) PROTECTIVE SLEEVE FOR GARMENT APPAREL

(76) Inventor: Thomas Conrad Williams, IV, 3138 Vera Ave., Los Angeles, CA (US) 90034

( * ) Notice: Subject to any disclaimer, the term of this patent is extended or adjusted under 35 U.S.C. 154(b) by 29 days.

(21) Appl. No.: 09/589,396

(22) Filed: Jun. 6, 2000

(51) Int. Cl.[7] ..... A41D 13/08

(52) U.S. Cl. ..... 2/59; 2/16; 602/62

(58) Field of Search ..... 2/59–61, 16, 22, 2/24, 46, 87, 170, 125–126, 243.1, 161.6, 167.7, 114, 93, DIG. 3, DIG. 11, 2.5, 108, 97, 164, 455, 457, 458, 2.11; 128/878; 602/20, 62–63

(56) References Cited

U.S. PATENT DOCUMENTS

| | | | | | |
|---|---|---|---|---|---|
| 3,657,741 | A | | 4/1972 | Blanco | |
| 4,393,865 | A | | 7/1983 | Lambert | |
| 4,416,641 | A | * | 11/1983 | Spinosa et al. | 441/94 |
| 4,504,978 | A | * | 3/1985 | Gregory et al. | 2/59 |
| 4,834,742 | A | | 5/1989 | Wilson et al. | |
| 4,843,645 | A | | 7/1989 | White | |
| 4,856,112 | A | * | 8/1989 | Effle | 2/59 |
| 4,895,569 | A | | 1/1990 | Wilson et al. | |
| 5,079,778 | A | | 1/1992 | Sloot | |
| 5,129,106 | A | * | 7/1992 | Liou | 2/441 |
| 5,187,813 | A | | 2/1993 | Klein | |
| 5,251,337 | A | | 10/1993 | Sloot | |
| 5,335,372 | A | | 8/1994 | Wiedner et al. | |
| 5,468,534 | A | | 11/1995 | Godfrey et al. | |
| 5,476,697 | A | | 12/1995 | Bellander | |
| 5,542,121 | A | | 8/1996 | Lahaussois et al. | |
| 5,592,953 | A | | 1/1997 | Delao | |
| 5,864,878 | A | | 2/1999 | Mashrick | |
| 5,924,130 | A | | 7/1999 | Fragomeli | |

FOREIGN PATENT DOCUMENTS

| | | | | |
|---|---|---|---|---|
| DE | 128715 | * | 12/1927 | 2/59 |
| GB | 2237975 | * | 5/1991 | 2/16 |

* cited by examiner

*Primary Examiner*—Gloria M. Hale
*Assistant Examiner*—Tejash Patel

(57) ABSTRACT

An embodiment of the invention includes a protective sleeve for garment apparel. The protective sleeve includes an inside material having an arm surface coupled to an inside wall and an outside material having a sterile surface coupled to an outside wall. The inside wall and the outside wall are coupled together to form an interior. Moreover, a fluid is placed within this interior.

15 Claims, 4 Drawing Sheets

PROTECTIVE SLEEVE FOR GARMENT APPAREL

BACKGROUND OF THE INVENTION

1. Field of the Invention

The invention includes protective sleeves for garment apparel. More specifically, a protective sleeve may be inflated with a liquid or gas, everted about a forearm for a snug fit and to expose a sterile surface on which to wipe a medical device, a forehead, a mouth, a window, a barber's razor, or the like.

2. Background Information

A sleeve may be thought of as a part of a garment apparel that covers all or part of a human arm. Sleeves are designed to add warmth to the body or aesthetic appeal to the garment to which it is attached. However, behavior being what it is, humans have used the sleeve as a convenient wiping tool. For example, doctors have used their sleeve to clean their medical devices, barbers have wiped their razors with their sleeve, and dads have wipe their car windows with their sleeve. Most egregiously, kids have used their sleeve to wipe their foreheads, mouths, and even their nose, all to the chagrin of their mom.

Over the centuries, devices have been developed to keep a sleeve clean. For example, to keep his troops from wiping their noses on their uniforms, Napoleon is claimed to have placed buttons on the posterior edge of his men's coat-sleeves. In more modern times, a garter has been employed by draftsmen as an elasticized band worn around the arm to keep the sleeve pushed up. In the medical field, inventors have patent sleeve garment protectors under U.S. Pat. No. 3,657,741, U.S. Pat. No. 5,335,372, U.S. Pat. No. 5,592,953, and U.S. Pat. No. 5,924,130. Napkins have been added to the sleeve under U.S. Pat. No. 4,393,865, U.S. Pat. No. 5,187,813, U.S. Pat. No. 5,468,534, and U.S. Pat, No. 5,476,697 to protect the sleeve during supper time. Moreover, to protect against the kid-wiping-the-sleeve scenario in general, one inventor patented a sleeve garment protector under U.S. Pat. No. 4,843,645.

A problem with each of the above sleeve garment protectors is thoroughness and efficiency with which a surface may be cleaned. To clean a dirty surface with a sleeve garment protector, the dirty surface and the sleeve garment protector are brought together under pressure and moved in relationship to one another. At those locations where the dirty surface contacts the sleeve garment protector, the dirty surface is wiped clean. As the total area over which the dirty surface contacts the sleeve garment protector increases, so does the thoroughness and efficiency with which a surface may be cleaned.

The total surface area over which the dirty surface contacts the sleeve garment protector is a function of the underlying support of the sleeve garment protector. In the case of a sleeve garment protector, the underlying support is a human arm. Due the human arm's cylindrical profile, the total area over which the dirty surface contacts the sleeve garment protector is at its minimum. This minimum contact is inefficient and requires much effort to clean a dirty surface.

SUMMARY OF THE INVENTION

An embodiment of the invention includes a protective sleeve for garment apparel. The protective sleeve includes an inside material having an arm surface coupled to an inside wall and an outside material having a sterile surface coupled to an outside wall. The inside wall and the outside wall are coupled together to form an interior. Moreover, a fluid is placed within this interior.

DETAILED DESCRIPTION OF THE INVENTION

Figure 1:
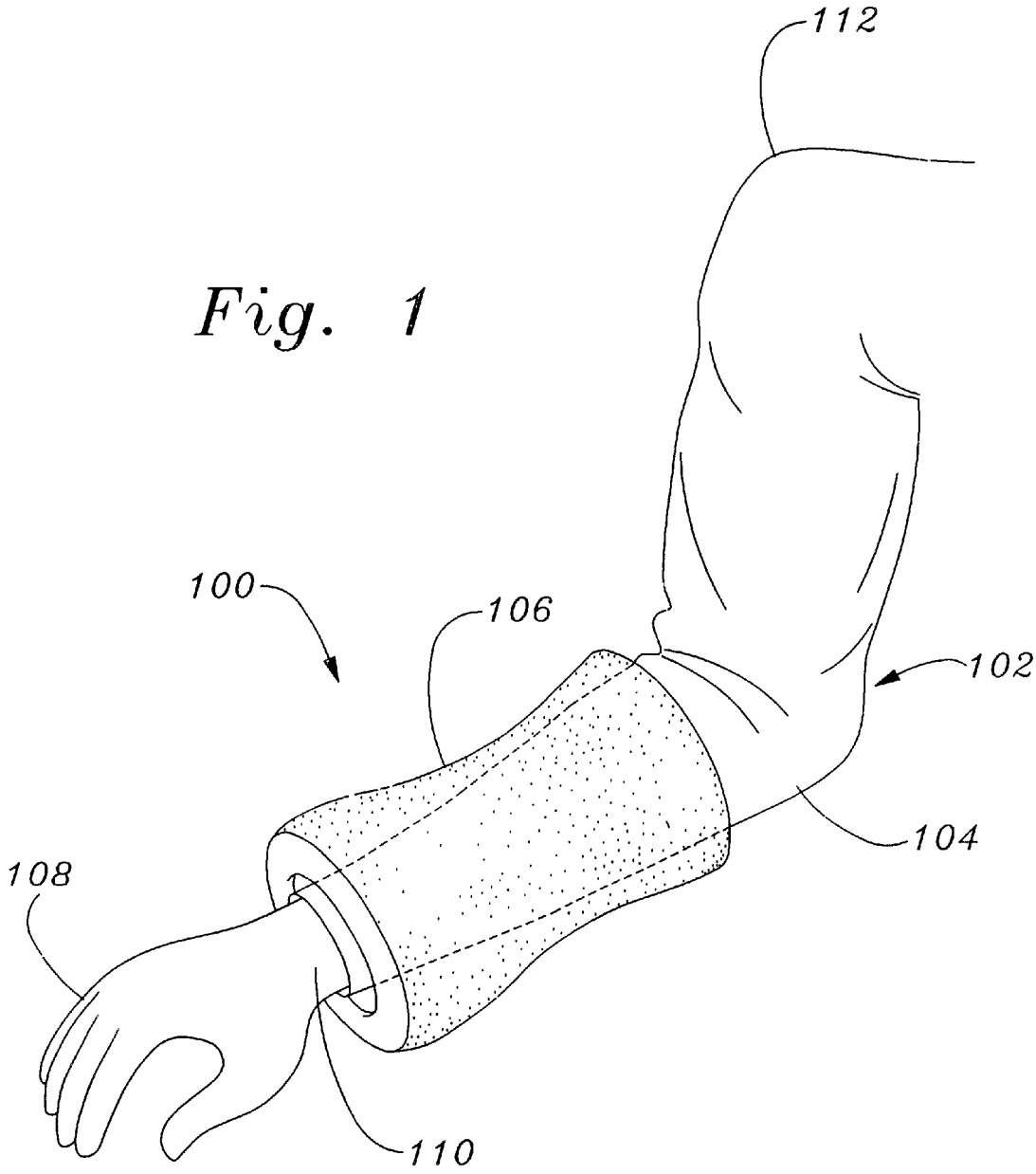
FIG. 1 illustrates sleeve system 100.

FIG. 1 illustrates sleeve system 100. Included with sleeve system 100 may be arm 102, sleeve garment apparel 104, and protective sleeve 106. Arm 102 may be an upper limb that connects hand 108 and wrist 110 to shoulder 112. As an upper limb, arm 102 may be an upper limb of the human body or an upper limb of a mannequin. Alternatively, arm 102 may be the forelimb of an animal or a long part that projects from a central support in a machine.

Sleeve garment apparel 104 may be that part of a shirt connected between a collar and a cuff. Alternatively, sleeve garment apparel 104 may be any material disposed about arm 102 to add warmth to arm 102, to add aesthetic appeal to arm 102, or to add aesthetic appeal to that to which sleeve garment apparel 104 may be attached.

Figure 2:
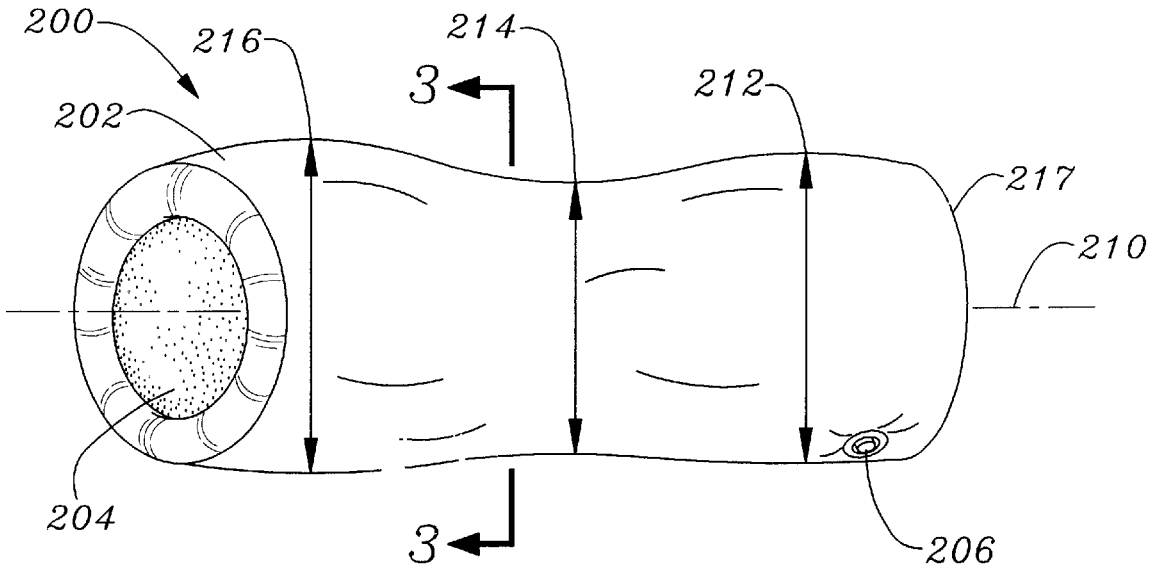
FIG. 2 shows protective sleeve 200 prior to installing onto an arm having a sleeve, such as arm 102/sleeve garment apparel 104 of FIG. 1.

Protective sleeve 106 may be disposed about sleeve garment apparel 104, arm 102, or a combination of garment apparel 104 and arm 102 and is discussed more fully in connection with FIG. 2.

Figure 3:
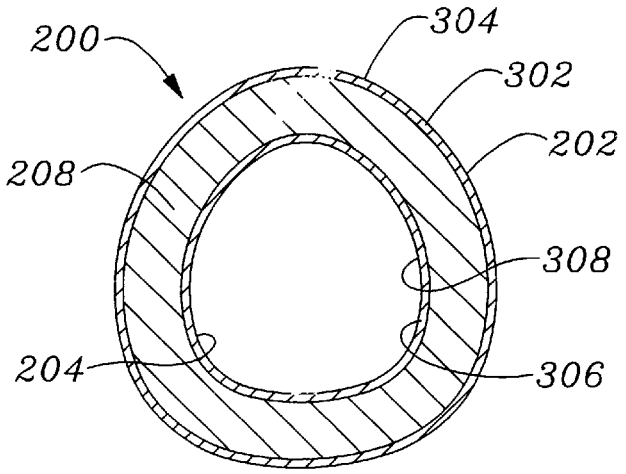
FIG. 3 illustrates a sectional view of protective sleeve 200 taken generally off of line 2—2 of FIG. 2.

FIG. 2 shows protective sleeve 200 prior to installing onto an arm having a sleeve, such as arm 102/sleeve garment apparel 104 of FIG. 1. Included with protective sleeve 200 may be inside material 202, outside material 204, inlet 206, and fluid 208 (FIG. 3). Inside material 202 and outside material 204 may be joined together to form a hollow interior.

As shown in FIG. 2, protective sleeve 200 is turned outwards so that inside material 202 is located at a radial distance from center line 210 that is greater than the radial distance between outside material 204 and center line 202. Protective sleeve 200 may be arranged in this manner during storage and during shipping so as to be inside out the entire time prior to installing onto an arm. This arrangement may provide a protective covering for outside material 204 as well as aid in installing protective sleeve 200 onto an arm (as discussed below).

The profile of protective sleeve 200 may be tailored to match the item onto which protective sleeve 200 is to be installed. For example, protective sleeve 200 may have a cylindrical profile, a cylindrical L-shaped profile, or an oblong tubular shaped profile. Additionally, the profile of protective sleeve 200 may be defined by a plurality of diameters.

As seen in FIG. 2, the profile of protective sleeve 200 may be defined by hand diameter 212, wrist diameter 214, and forearm diameter 216. These diameters may be proportional to the diameter relationship of the hand, wrist, and forearm of a human being as understood through ergonomics. Ergonomics is the applied science of equipment design, as for the workplace, intended to maximize productivity by reducing operator fatigue and discomfort. Also called biotechnology, human engineering, human factors engineering, ergonomics includes detailed tables of human measurements and statistics that may be used in equipment design. In one embodiment, each of hand diameter 212, wrist diameter 214, and forearm diameter 216 has a diameter that is proportional to the hand, wrist, and forearm diameter of less than or equal to 80% of men between the ages of eighteen and sixty-five or less than or equal 90% or women between the ages of eighteen and sixty-five.

In another embodiment, the ratio of hand diameter 212 to wrist diameter 214 to forearm diameter 216 is 3.0 to 2.5 to 4.0 (or 3.0:2.5:4.0).

Inlet 206 may be a valve that permits the introduction of fluid 208 to the interior of protective sleeve 200. Inlet 206 may also retain fluid 208 within this interior as well as permit this fluid to be removed from the interior of protective sleeve 200. Inlet 206 may be coupled to a reservoir of fluid 208 so as to circulate fluid 208 into and out of the interior of protective sleeve 200 while protective sleeve 200 is being worn.

FIG. 3 illustrates a sectional view of protective sleeve 200 taken generally off of line 2—2 of FIG. 2. Inside material 202 may include inside wall 302, about which arm surface 304 may be disposed. Outside material 204 may include outside wall 306, against which sterile surface 308 may be disposed.

Inside wall 302 and outside wall 306 may be made of plastic. Alternatively, inside wall 302 and outside wall 306 may be made of a semipermeable membrane that permits the diffusion of human perspiration into the inside of protective sleeve 200 while retaining fluid 208 within the inside of protective sleeve 200.

Arm surface 304 may be a material that enjoys a high degree of friction when in contact with clothing material, such as the material of sleeve garment apparel 104. Arm surface 304 may be releaseably attached to inside wall 302 through adhesive or other attaching material. Sterile surface 308 may be a cotton material, a paper material, or other material that may be used to wipe a dirty surface. Sterile surface 308 may be releaseably attached to outside wall 306 through adhesive, such as that used on Post-It® Notes, or through Velcro®.

Protective sleeve 200 may be inflated with fluid 208 through inlet 206 of FIG. 2. Fluid 208 may be a liquid, such as water, glycerol, or silicon. Alternatively, fluid 208 may be a gas, such as air. Preferably, this gas is a lighter-than-air-gas, such as helium, since this a lighter-than-air-gas would aid raising arm 102 to wipe a dirty surface.

Protective sleeve 200 for garment apparel may be manufactured by first presenting inside material 202 having arm surface 304 and inside wall 302. Arm surface 304 may be coupled to inside wall 302. Next, outside material 204 having sterile surface 308 and outside wall 306 may be presented. Then, sterile surface 308 may be coupled to outside wall 306. Inside wall 302 and outside wall 306 may then be coupled together to form an interior. Last, fluid 208 may be placed within the interior.

Figure 4A:
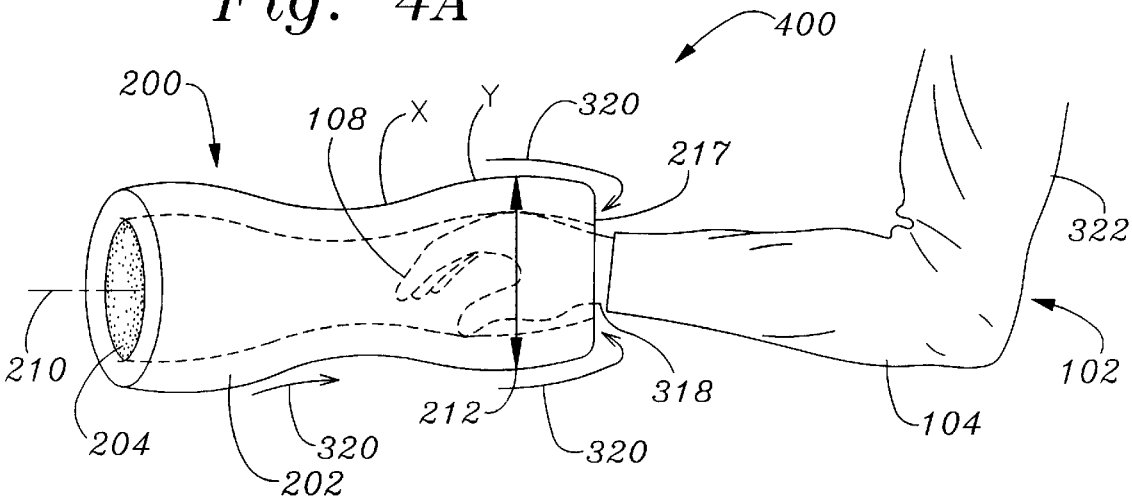
FIG. 4A, 4B, and 4C illustrate method 400 of the invention.
Figure 4B:
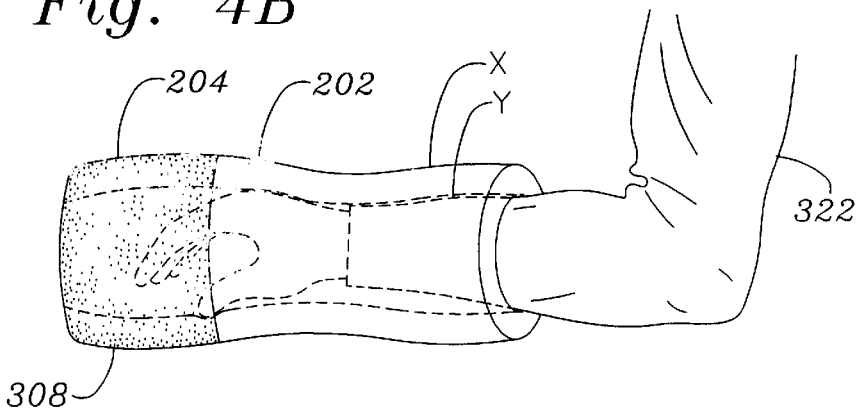
Figure 4C:
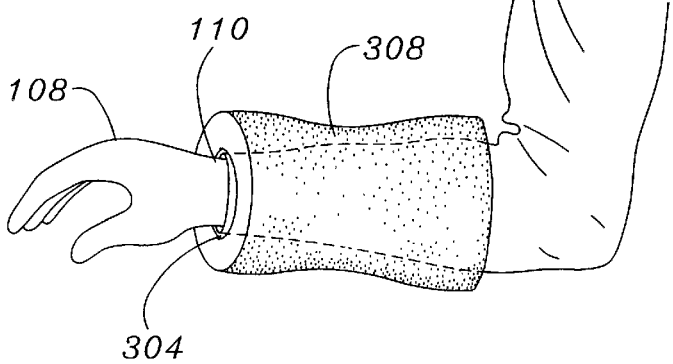

The figures related to FIGS. 4A, 4B, and 4C illustrate method 400 of the invention. Method 400 may involve the installation of protective sleeve 200 over sleeve garment apparel 104 loosely fit over arm 102 through a everting process. Everting may be thought of as a process where something is turn inside out or outward.

At step 402, hand end 217 may be passed over hand 108 so that hand diameter 212 resides radially adjacent to hand 108 as seen in FIG. 4A. In this position, protective sleeve 200 resides at posterior (remote) edge 318 of sleeve garment apparel 104. Point X and point Y reside on the exterior of protective sleeve 200.

At step 404, protective sleeve 200 then may be rolled in the direction of arrows 320 towards anterior (upper) edge 322 of sleeve garment apparel 104. As protective sleeve 200 is rolled towards anterior edge 322 of sleeve garment apparel 104, inside material 202 moves to the interior of protective sleeve 200 and outside material 204 moves to the exterior of protective sleeve 200. This is seen in FIG. 4B. Point X still remains on the exterior of protective sleeve 200. However, point Y has moves against sleeve garment apparel 104 and into the interior of protective sleeve 200.

Recall that arm surface 304 may be a material that enjoys a high degree of friction when in contact with clothing material, such as the material of sleeve garment apparel 104. This high degree of friction prevents sleeve garment apparel 104 from moving towards anterior edge 322 as protective sleeve 200 is rolled towards anterior edge 322. This, in turn, permits a snug fit between protective sleeve 200 and arm 102 without concern that sleeve garment apparel 104 will be rolled up.

Figure 5:
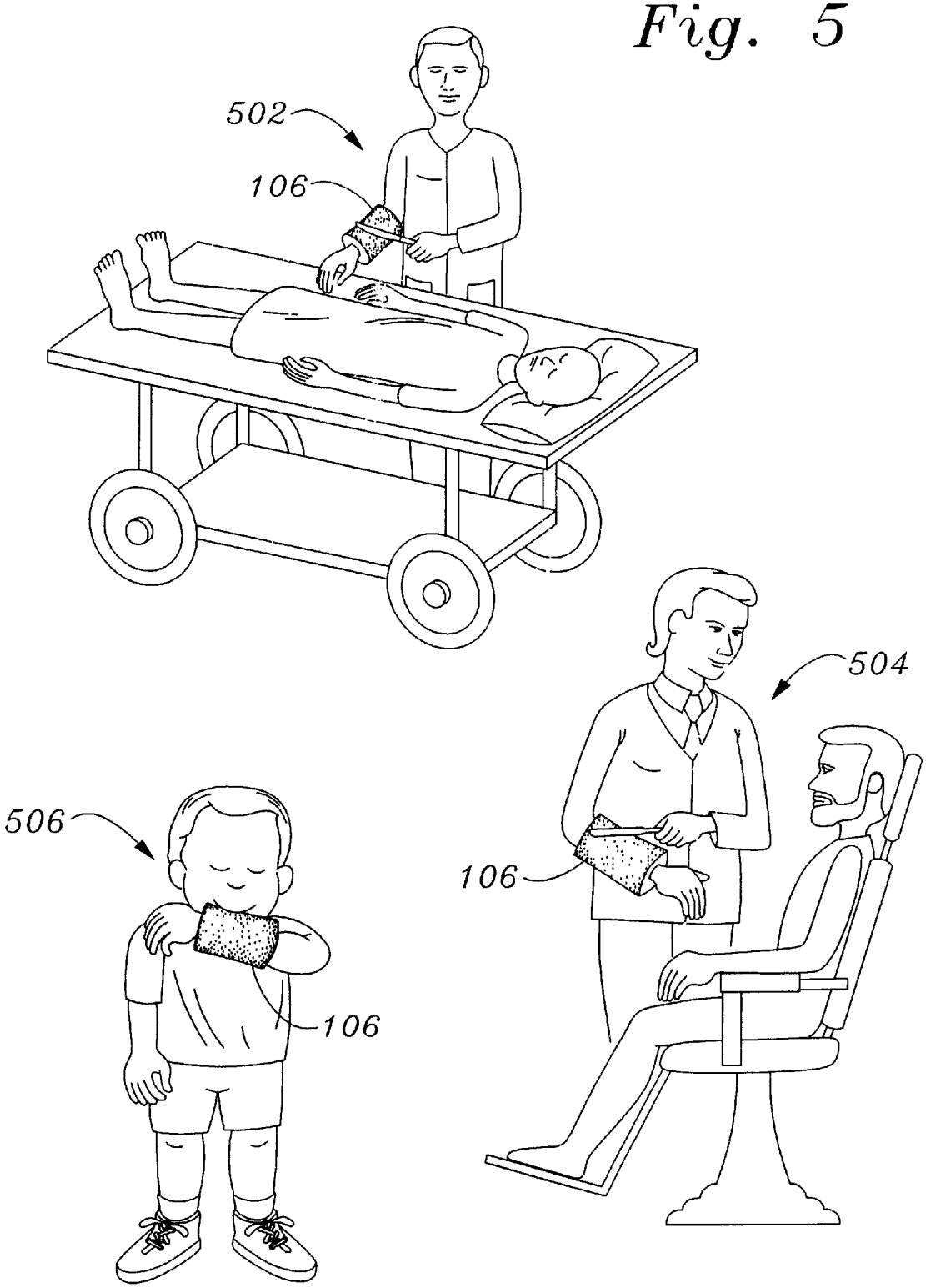
FIG. 5 illustrates protective sleeve 200 being used by doctor 502, barber 504, and kid 506.

At step 406, protective sleeve 200 is stopped from rolling towards anterior edge 322. Here, protective sleeve 200 is in its application state with sterile surface 308 now exposed. At step 408, sterile surface 308 may be brought into contact under pressure with a dirty surface, such as a medical device, a forehead, a mouth, a window, a barber's razor, or the like. Since the underlying support of sterile surface 308 is fluid 208, sterile surface 308 is able to conform to the profile of the item to be cleaned, even where that profile is an irregular shape. FIG. 5 illustrates protective sleeve 200 being used by doctor 502, barber 504, and kid 506.

Protective sleeve 200's ability to conform to an irregularly shaped profile increases the total surface area over which the dirty surface contacts protective sleeve 200. Since the total area over which the dirty surface contacts the sleeve garment protector increases, so does the thoroughness and efficiency with which a surface may be cleaned by protective sleeve 200.

The exemplary embodiments described herein are provided merely to illustrate the principles of the invention and should not be construed as limiting the scope of the subject matter of the terms of the claimed invention. The principles of the invention may be applied toward a wide range of systems to achieve the advantages described herein and to achieve other advantages or to satisfy other objectives, as well.

What is claimed is:

1. A protective sleeve for garment apparel, the protective sleeve comprising:

an inside material having an arm surface coupled to an inside wall;

an outside material having a sterile surface coupled to an outside wall, wherein the inside wall end the outside wall are coupled together to form an interior;

a fluid disposed within the interior; and an inlet coupled to the inside material, where, in a first position, the inlet resides on the exterior of the protective sleeve and in a second position the inlet resides on the interior of the protective sleeve.

2. The protective sleeve of claim 1 having a first position and a second position, where, in the first position, the outside material resides on an interior of the protective sleeve and the inside material resides on an exterior of the protective sleeve.

3. The protective sleeve of claim 1, wherein the fluid is at least one of water and air.

4. The protective sleeve of claim 1, wherein the fluid is a gas that is lighter than air.

5. The protective sleeve of claim 4, wherein the lighter than air gas is helium.

6. The protective sleeve of claim 1, wherein the sterile surface is releaseably coupled to the outside wall.

7. The protective sleeve of claim 1 having a profile, wherein the profile is defined by a plurality of diameters.

8. The protective sleeve of claim 7, wherein the plurality of diameters are three diameters: a hand diameter, a wrist diameter, and a forearm diameter.

9. The protective sleeve of claim 8, wherein each of the hand diameter, the wrist diameter, and the forearm diameter is defined by a diameter that is proportional to the hand, wrist, and forearm diameter of less than or equal to 80% of men between the ages of eighteen and sixty-five.

10. The protective sleeve of claim 9, wherein the ratio of the hand diameter to the wrist diameter to the forearm diameter is 3.0 to 2.5 to 4.0.

11. A method to manufacture a protective sleeve for garment apparel, the method comprising:

presenting an inside material having an arm surface and an inside wall;

coupling the arm surface to the inside wall;

presenting an outside material harming a sterile surface and an outside wall;

coupling the sterile surface to the outside wall;

coupling the inside wall and the outside wall together to form an interior;

coupling an inlet to the inside material; and disposing a fluid within the interior.

12. The method of claim 11, wherein disposing a fluid within the interior includes disposing helium within the interior through the inlet.

13. A method of installing a protective sleeve for garment apparel onto an arm, the method comprising:

presenting a protective sleeve, the protective sleeve having an inside material having an arm surface coupled to an inside wall, an outside material having a sterile surface coupled to an outside wall, wherein the inside wall and the outside wall are coupled together to form an interior, and a fluid disposed within the interior;

passing a first end of the protective sleeve over a first end of the arm; and rolling the protective sleeve towards a second end of the arm until the protective sleeve is everted.

14. The method of claim 13, wherein presenting a protective sleeve includes presenting a protective sleeve further having an inlet coupled to the inside material.

15. The method of claim 13, wherein rolling the protective sleeve towards the second end of the arm until the protective sleeve is everted includes rolling the protective sleeve towards the second end of the arm until the sterile surface of the protective sleeve is exposed on an exterior of the protective sleeve.

* * * * *